US009714763B1

(12) United States Patent
Hsieh

(10) Patent No.: US 9,714,763 B1
(45) Date of Patent: Jul. 25, 2017

(54) LAMP ASSEMBLY AND LAMP DEVICE HAVING THE SAME

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 15/004,446

(22) Filed: Jan. 22, 2016

(51) Int. Cl.

| | |
|---|---|
| ***F21V 29/00*** | (2015.01) |
| ***F21V 29/83*** | (2015.01) |
| *F21Y 115/10* | (2016.01) |
| *F21Y 105/18* | (2016.01) |

(52) U.S. Cl.
CPC ..... *F21V 29/83* (2015.01); *F21Y 2105/18* (2016.08); *F21Y 2115/10* (2016.08)

(58) Field of Classification Search
CPC ..... F21V 29/83
USPC ..... 362/294, 249.06, 373
See application file for complete search history.

(56) References Cited

U.S. PATENT DOCUMENTS

2013/0039041 A1* 2/2013 Yeh ..... F21S 8/04 362/147
2013/0163248 A1* 6/2013 Lynch ..... F21S 8/02 362/249.02

* cited by examiner

*Primary Examiner* — Thomas M Sember
(74) *Attorney, Agent, or Firm* — Hamre, Schumann, Mueller & Larson, P.C.

(57) ABSTRACT

A lamp assembly includes a base plate and a plurality of light emitting units. The base plate has a first surface and a second surface opposite to the first surface. The base plate is formed with a plurality of first heat-dissipating holes extending through the first and second surfaces, and a plurality of second heat-dissipating holes extending through the first and second surfaces and possessing a diameter smaller than that of the first heat-dissipating holes. The plurality of light emitting units are mounted on the first and second surfaces.

9 Claims, 11 Drawing Sheets

LAMP ASSEMBLY AND LAMP DEVICE HAVING THE SAME

FIELD

The disclosure relates to a lamp assembly, more particularly to a lamp assembly that can illuminate toward opposite directions, and a lamp device having the lamp assembly.

BACKGROUND

A conventional lamp device generally includes a base plate, and a plurality of light-emitting diodes (hereinafter abbreviated as LEDs) mounted on the base plate. During operation of the conventional lamp device, the LEDs may generate heat which, without being efficiently dissipated, may cause damage to the LEDs.

SUMMARY

Therefore, an object of the disclosure is to provide a two-sided lighting lamp assembly that has a relative high heat dissipating efficiency.

According to the disclosure, a lamp assembly includes a base plate and a plurality of light emitting units. The base plate has a first surface and a second surface opposite to the first surface. The base plate is formed with a plurality of first heat-dissipating holes extending through the first and second surfaces, and a plurality of second heat-dissipating holes extending through the first and second surfaces and possessing a diameter smaller than that of the first heat-dissipating holes. The light emitting units are mounted on the first and second surface.

Another object of the disclosure is to provide a lamp device having the abovementioned lamp assembly.

Accordingly, a lamp device includes a lamp seat, the abovementioned lamp assembly, and a transparent lamp cover that is connected to the lamp seat and that encloses the lamp assembly therein.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
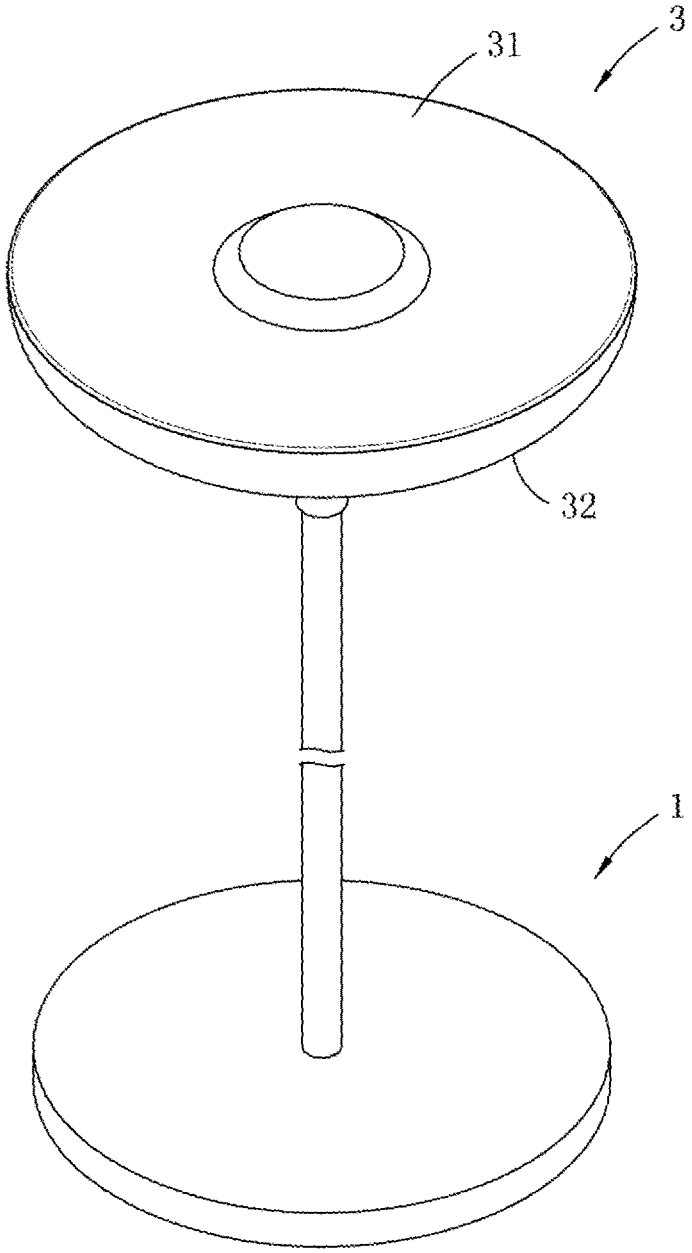
FIG. 1 is a fragmentary perspective view illustrating a first embodiment of a lamp device according to the disclosure.

Before the present invention is described in greater detail, it should be noted that like elements are denoted by the same reference numerals throughout the disclosure.

Figure 2:
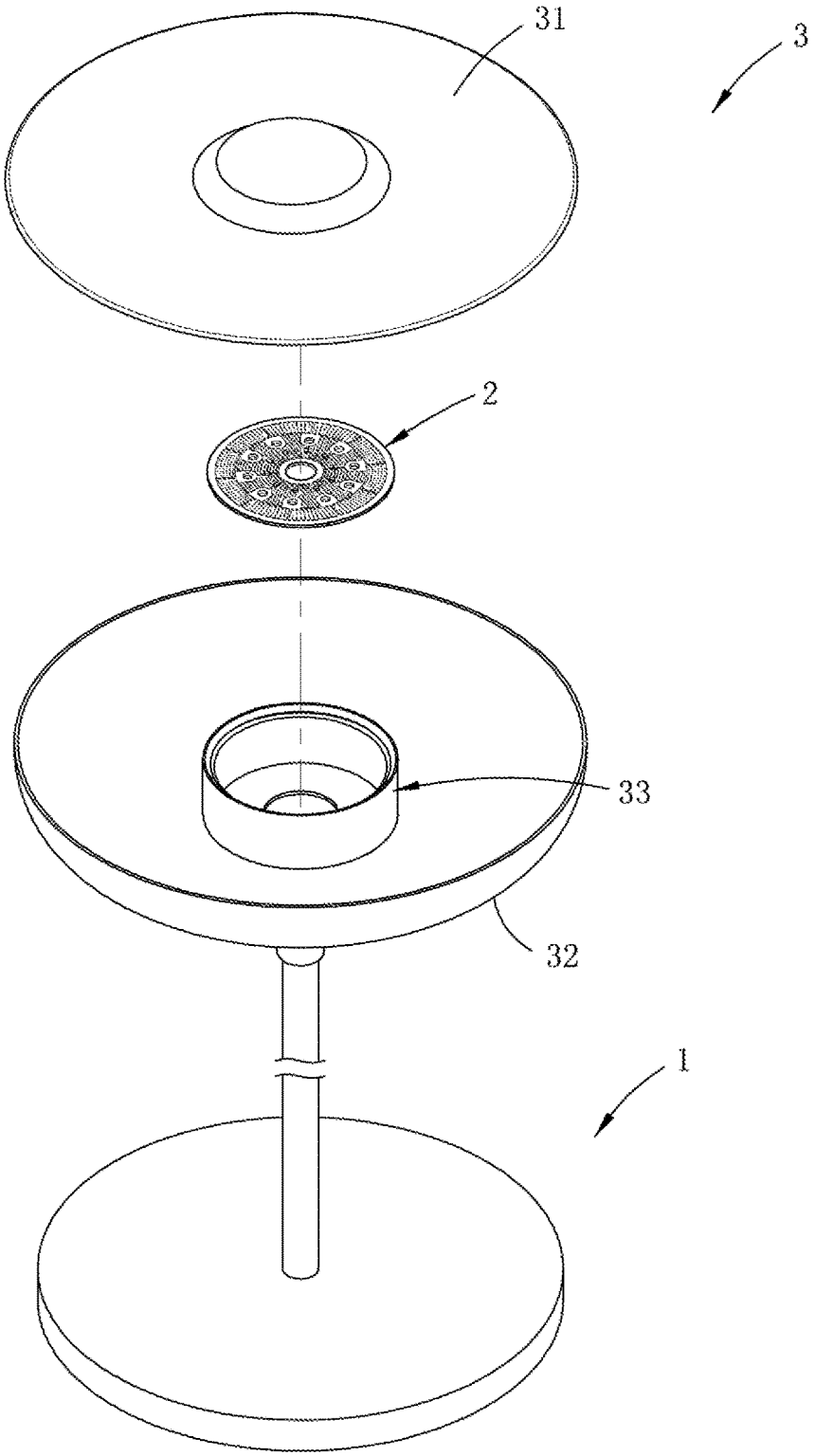
FIG. 2 is a fragmentary exploded perspective view of the first embodiment.

Referring to FIGS. 1 and 2, a first embodiment of a lamp device according to the disclosure is illustrated. The lamp device includes a lamp seat 1, a lamp assembly 2, and a transparent lamp shade 3 that is connected to the lamp seat 1 and that encloses the lamp assembly 2 therein. In this embodiment, the lamp seat 1 has a platform and an elongated pole extending from the platform. However, the shape of the lamp seat 1 may vary in other embodiments.

Figure 3:
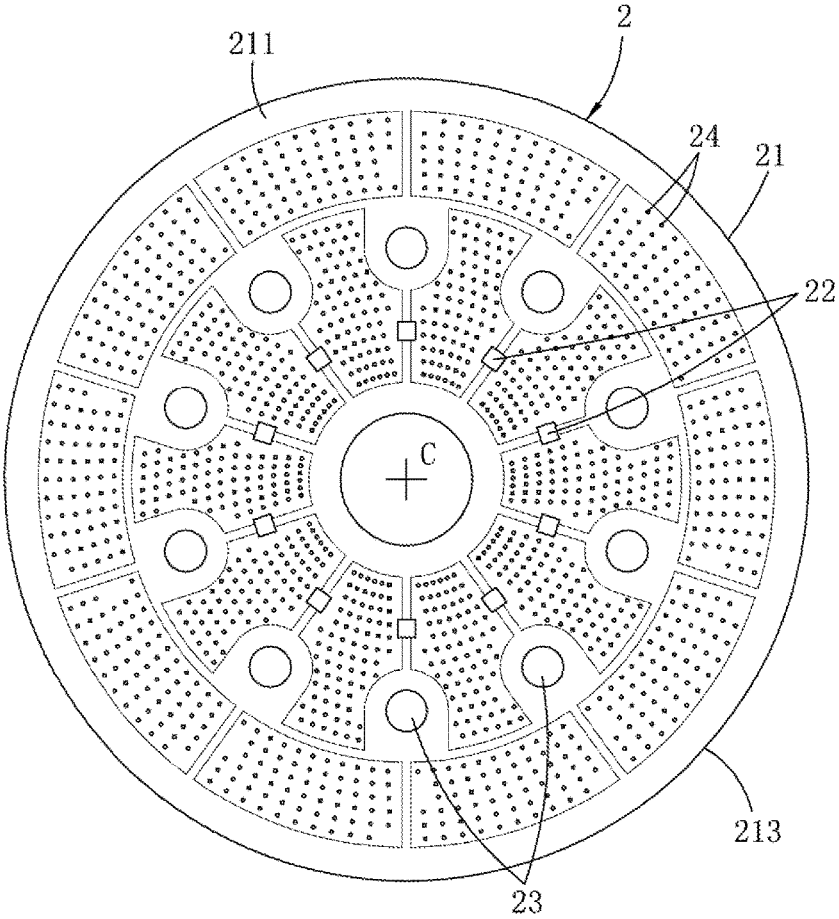
FIG. 3 is a top view illustrating a lamp assembly of the first embodiment.
Figure 4:
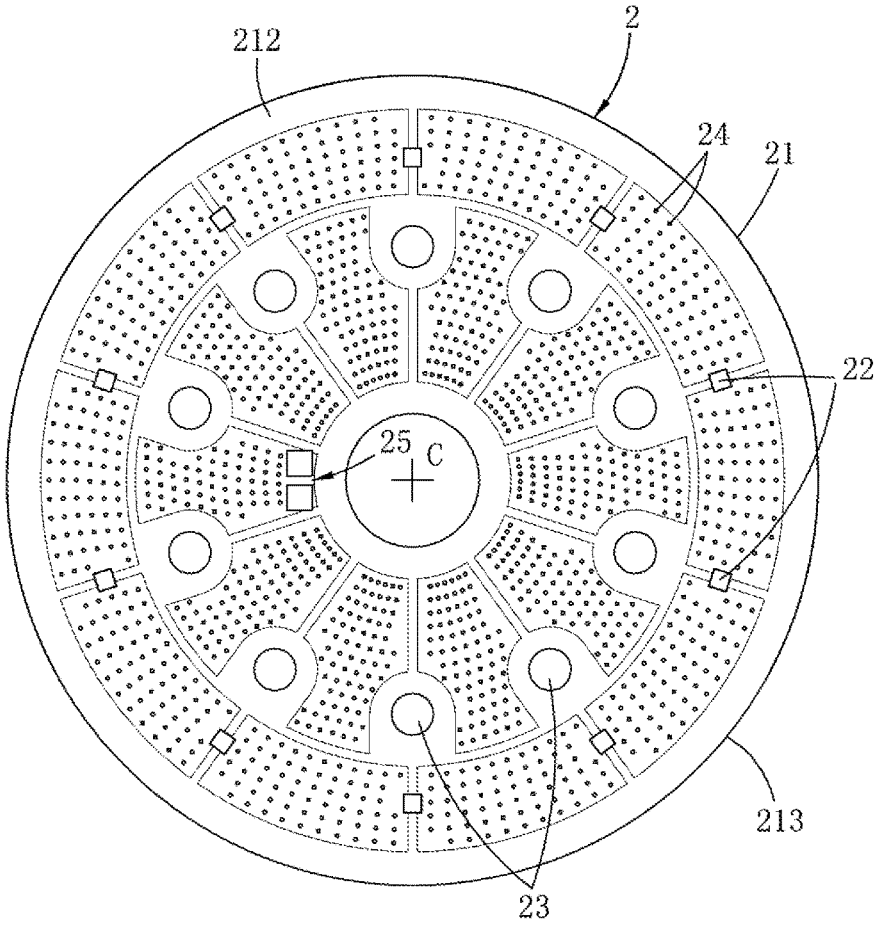
FIG. 4 is a bottom view of the lamp assembly of the first embodiment.

As shown in FIGS. 3 and 4, the lamp assembly 2 according to the disclosure includes a base plate 21, a plurality of light emitting units 22, and a driving unit 25.

The base plate 21 has a center (C), an outer edge 213 radially distal from the center (C), a first surface 211, and a second surface 212 opposite to the first surface 211. Moreover, the base plate 21 is formed with a plurality of first heat-dissipating holes 23 extending through the first and second surfaces 211, 212, and a plurality of second heat-dissipating holes 24 extending through first and second surfaces, 211, 212 and possessing a diameter smaller than that of the first heat-dissipating holes 23. The first heat-dissipating holes 23 of the base plate 21 are angularly spaced apart from each other and surround the center (C). The second heat-dissipating holes 24 surround the light emitting units 22.

In this embodiment, the light emitting units 22 are LEDs, and are mounted on the first and second surfaces 211, 212, so that the lamp assembly 2 is able to emit light from both of the first and second surfaces 211, 212. Some of the light emitting units 22 are angularly spaced apart from each other, are mounted on the first surface 211 of the base plate 21, are respectively and radially spaced apart from the first heat-dissipating holes 23, and are disposed between the center (C) of the base plate 21 and the first heat-dissipating holes 23. The remainder of the light emitting units 22 are angularly spaced apart from each other, are mounted on the second surface 212 of the base plate 21, are respectively and radially spaced apart from the first heat-dissipating holes 23, and are disposed between the first heat-dissipating holes 23 and the outer edge 213 of the base plate 21 (i.e., the light emitting units 22 mounted on the first surface 211 are located closer to the center (C) than the. remainder of the light emitting units 22 mounted on the second surface 212).

The driving unit 25 is mounted on the second surface 212 of the base plate 21, and is connected electrically to the light emitting units 22 for driving operation of the light emitting units 22.

By virtue of the arrangement of the first heat-dissipating holes 23 and the arrangement of the second heat-dissipating holes 24 that are evenly distributed on the base plate 21, air flow through the lamp assembly 2 is facilitated, thereby enhancing heat dissipating efficiency of the lamp assembly 2.

Figure 5:
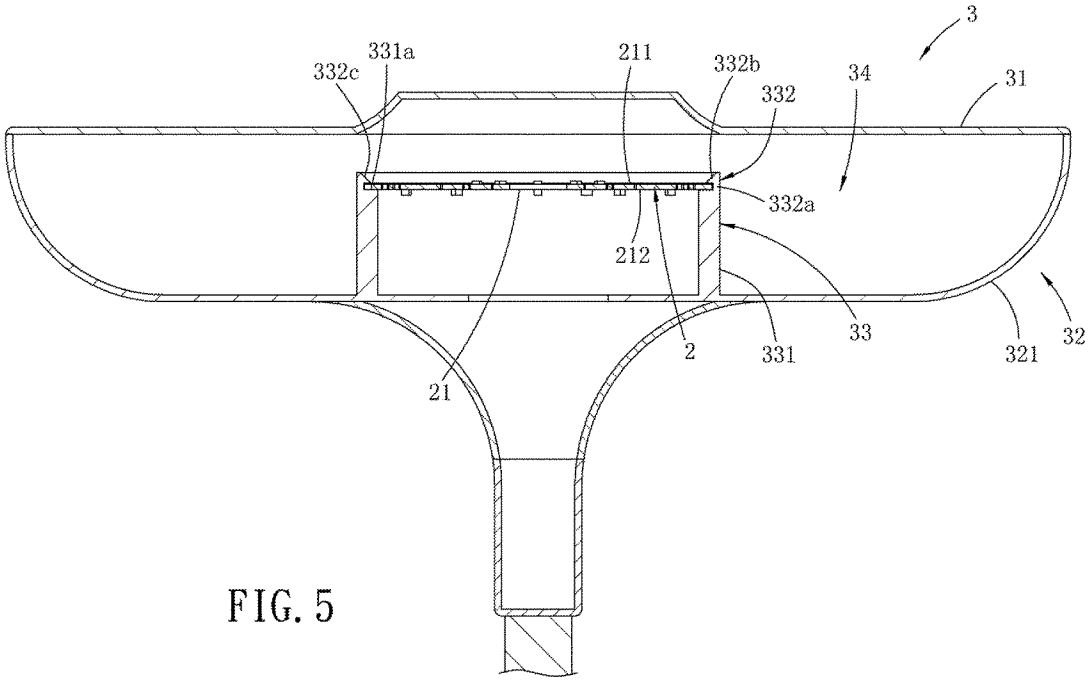
FIG. 5 is a fragmentary sectional view of the first embodiment.

As shown in FIGS. 2 and 5, the lamp shade 3 includes an upper shade member 31, and a lower shade member 32 that is connected to the lamp seat 1 and that cooperates with the upper shade member 31 to define an internal space 34 therebetween. In this embodiment, the upper shade member 31 is substantially plate-shaped, and the lower shade member 32 includes a main body 321 that is bowl-shaped and opens toward the upper member 31. The lower member 32 further includes a tubular mounting seat 33 disposed in the internal space 34 and mounted with the lamp assembly 2.

Specifically, the mounting seat 33 of the lamp shade 3 has a round wall 331 and a fastening wall 332. The round wall 331 has a top surface 331*a* that supports the second surface 212 of the base plate 21 thereon. The fastening wall 332 is flexible, and has a surrounding portion 332*a* that is connected to the top surface 331*a* of the round wall 331 and that surrounds the base plate 21, and a lock portion 332*b* that is connected to a top end of the surrounding portion 332*a*, that extends inwardly, that abuts against the first surface 211 of the base plate 21, and that has an inclined inner surrounding surface 332*c* for facilitating mounting of the base plate 21. Therefore, the base plate 21 can be snap-fitted to the mounting seat 33 with the guidance of the inclined inner surrounding surface 332*c*.

Figure 6:
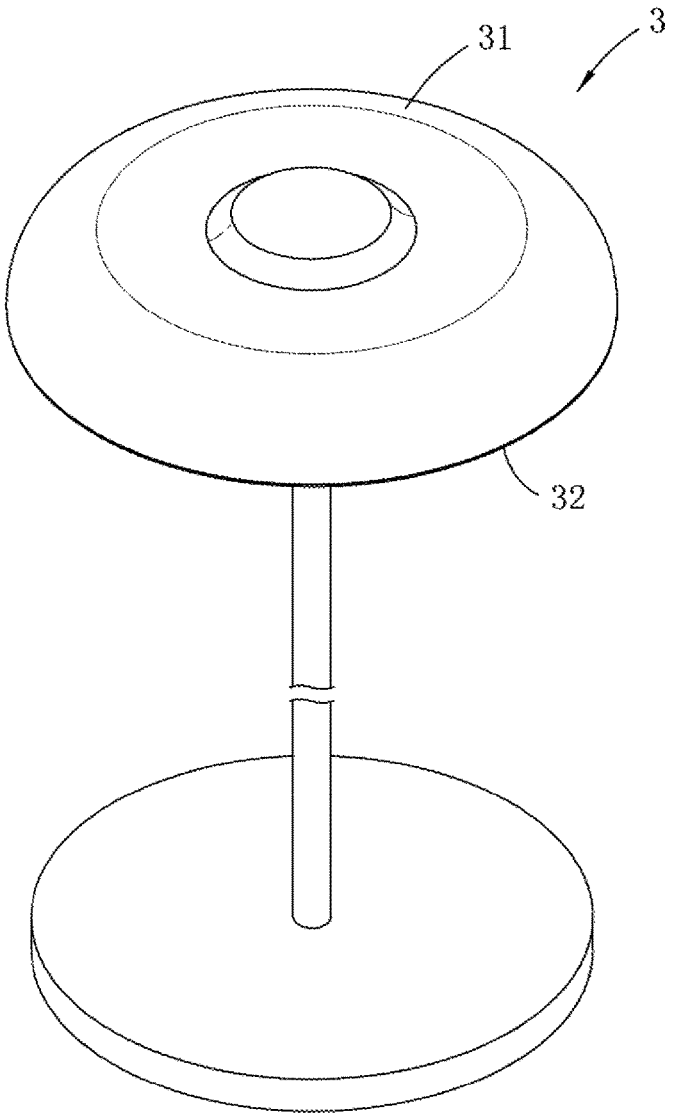
FIG. 6 is a fragmentary perspective view illustrating a second embodiment of the lamp device according to the disclosure.
Figure 7:
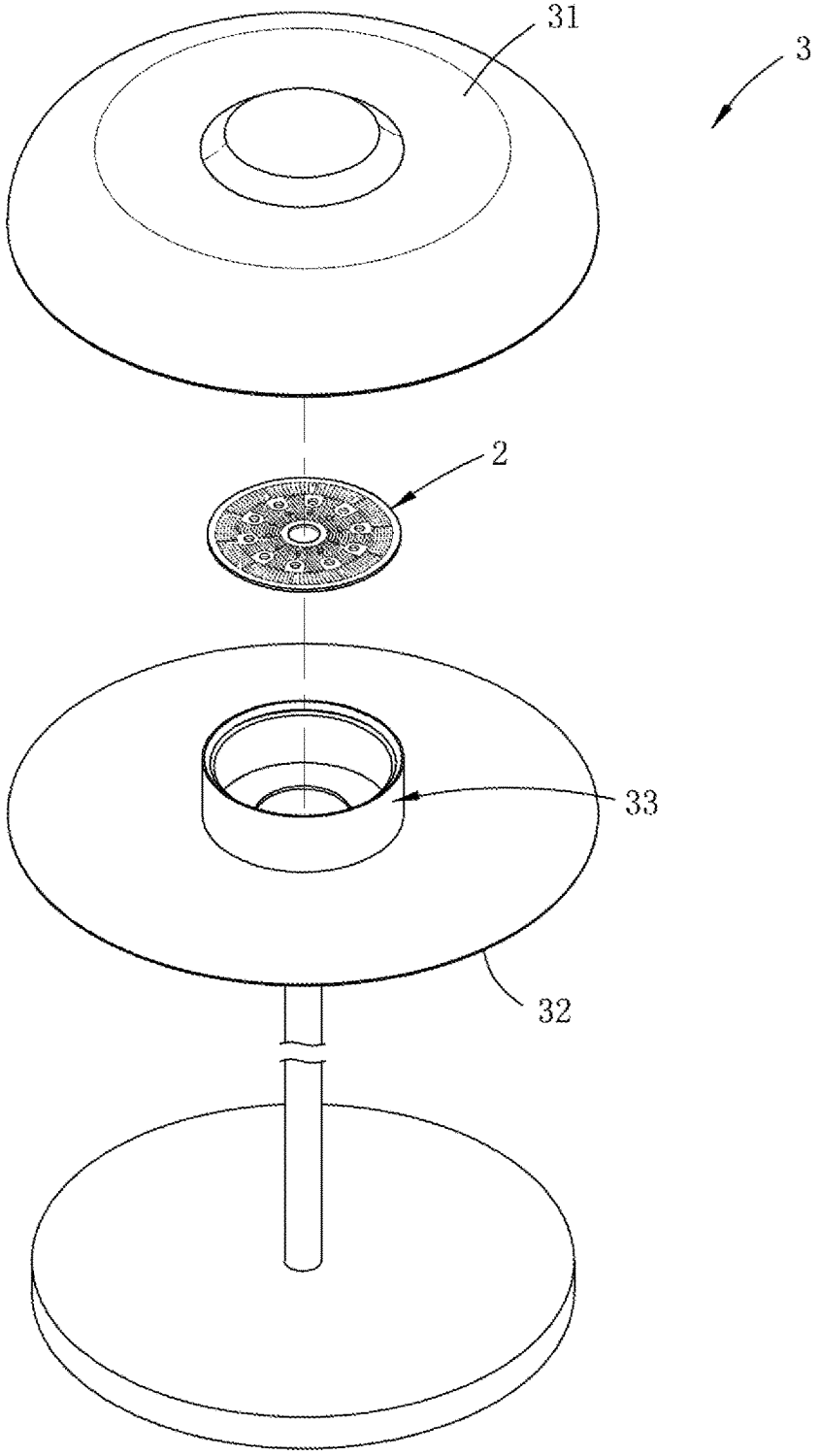
FIG. 7 is a fragmentary exploded perspective view of the second embodiment.
Figure 8:
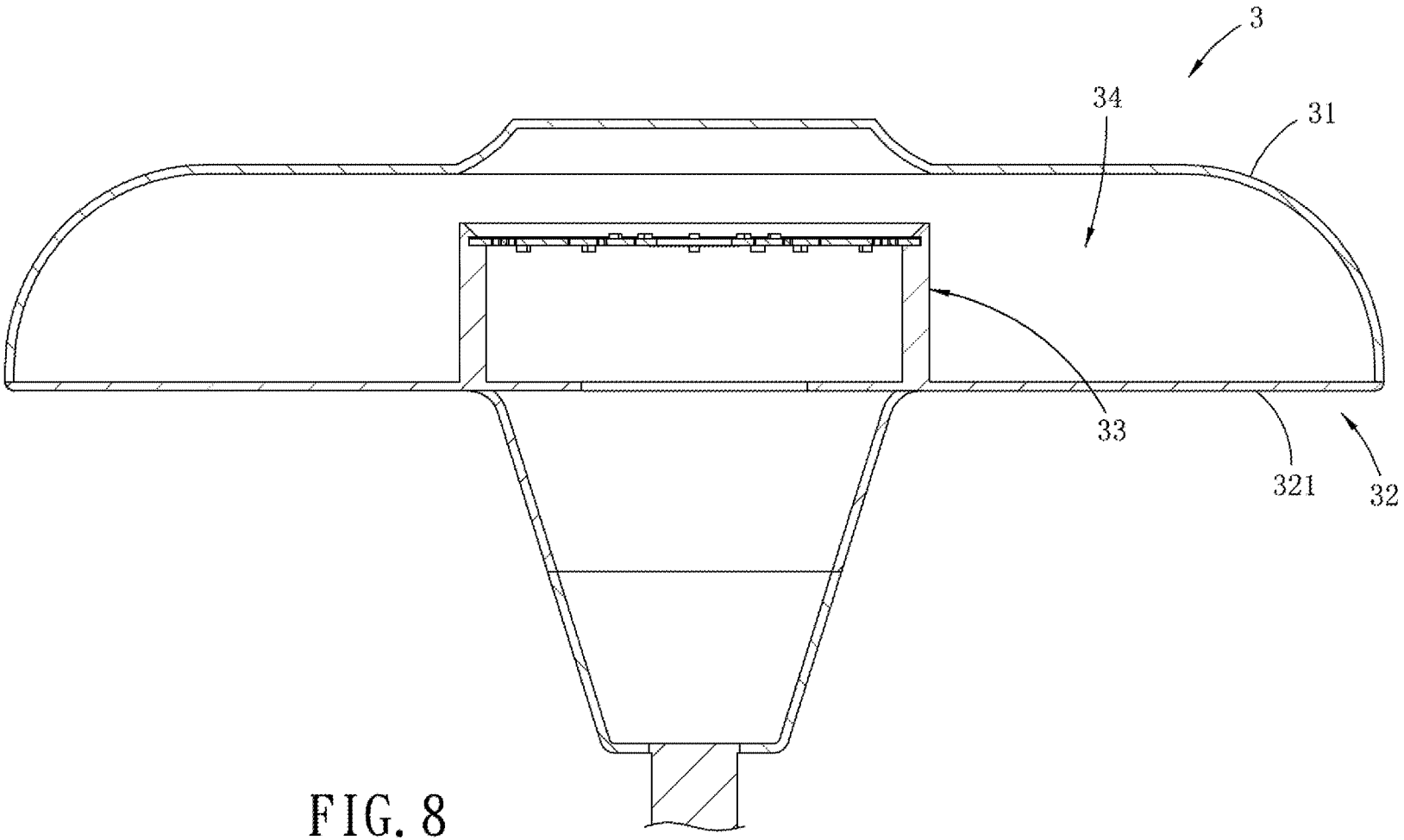
FIG. 8 is a fragmentary sectional view of the second embodiment.

As shown in FIGS. 6 to 8, a second embodiment of the lamp device has a structure similar to that of the first embodiment, except that the upper shade member 31 is inverted bowl-shaped and opens toward the lower member 32, and that the main body 321 of the lower shade member 32 is substantially flat.

Figure 9:
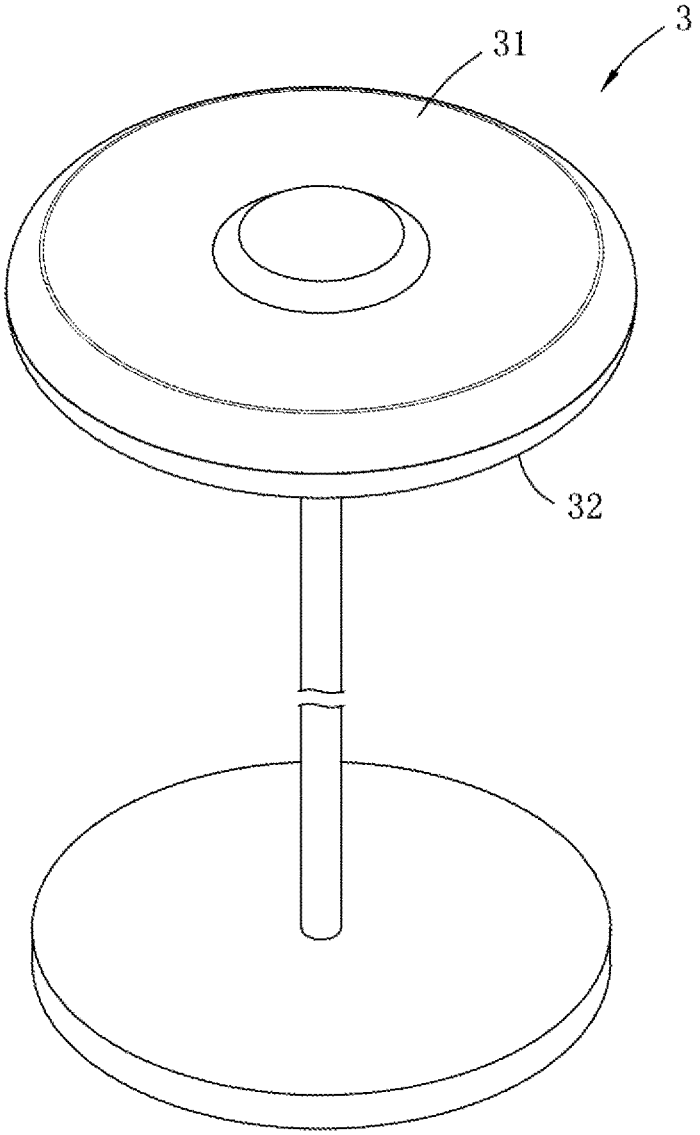
FIG. 9 is a fragmentary perspective view illustrating a third embodiment of the lamp device according to the disclosure.
Figure 10:
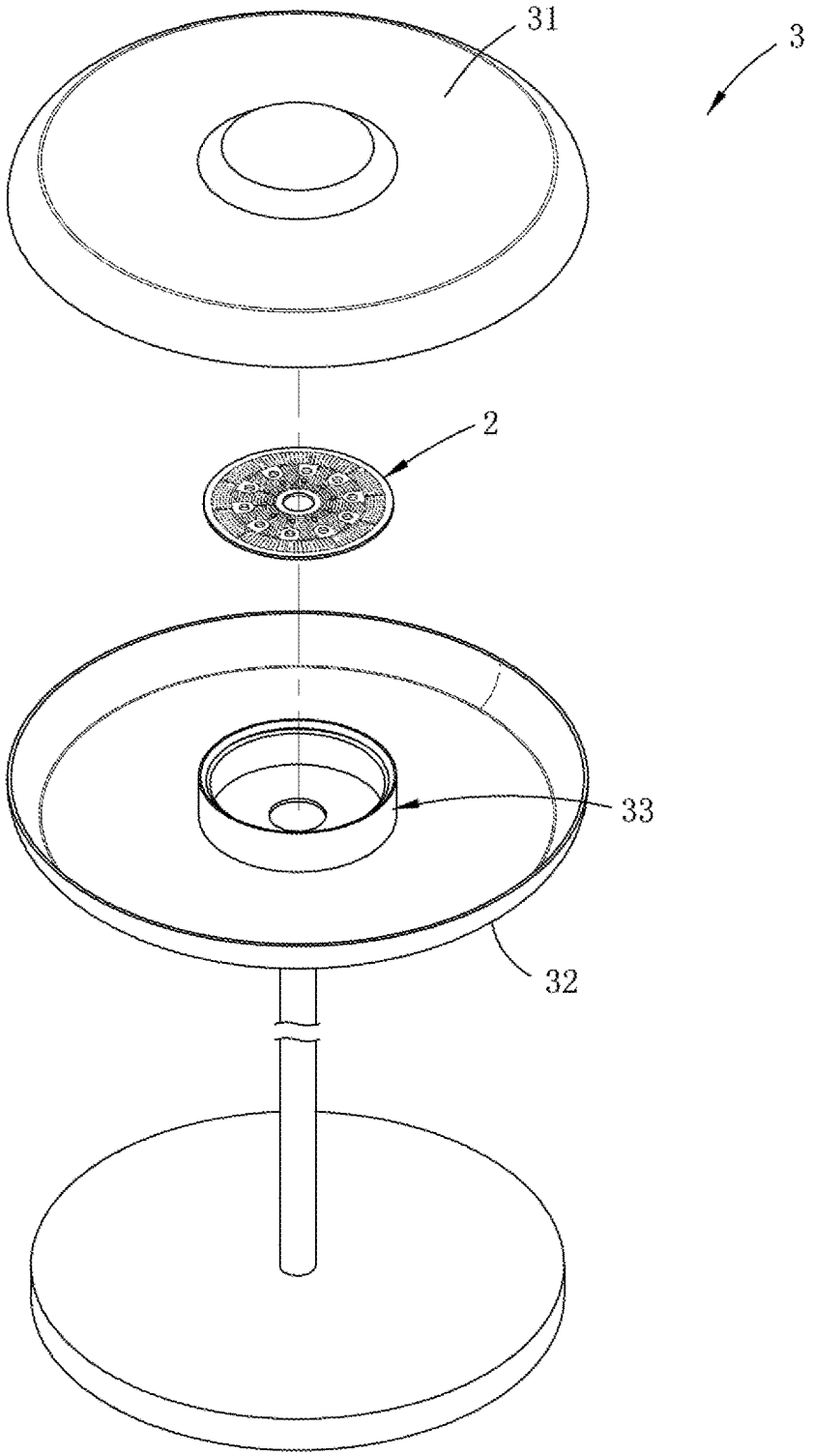
FIG. 10 is a fragmentary exploded perspective view of the third embodiment.
Figure 11:
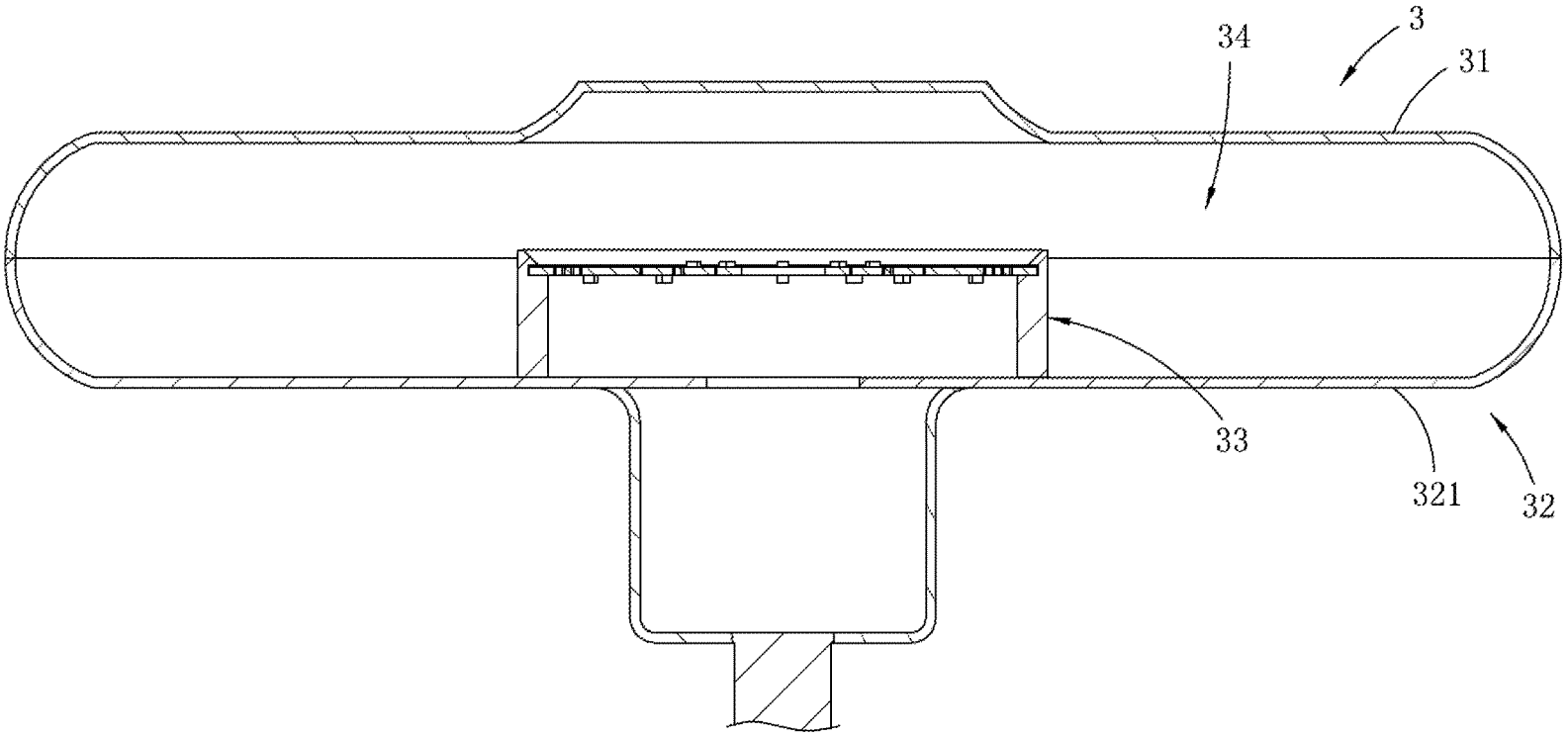
FIG. 11 is a fragmentary sectional view of the third embodiment.

As shown in FIGS. 9 to 11, a third embodiment of the lamp device has a structure similar to that of the first embodiment, except that the upper shade member 31 is inverted bowl-shaped and opens toward the lower member 32, and that the main body 321 of the lower shade member 32 is bowl-shaped and opens toward the upper member 31. In this embodiment, each of the upper and lower shade members 31, 32 has a depth which is half of that of the lower shade member 32 disclosed in the first embodiment.

In summary view of the foregoing embodiments, due to the fact that the light-emitting units 22 of the lamp assembly 2 are mounted on the first and second surfaces 211, 212 the base plate 21, the lamp device according to the disclosure is able to provide a two-sided lighting function for a broader area of illumination. Furthermore, by virtue of the first and second heat dissipating holes 23, 24 that extend through the base plate 21 and that are aptly-arranged relative to the light-emitting units 22, the lamp device according to the disclosure can provide better heat dissipating efficiency.

While the present invention has been described in connection with what is considered the exemplary embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lamp assembly comprising:

a base plate that has a first surface and a second surface opposite to said first surface, and that is formed with a plurality of first heat-dissipating holes extending through said first and second surfaces, and a plurality of second heat-dissipating holes extending through said first and second surfaces and possessing a diameter smaller than that of said first heat-dissipating holes; and a plurality of light emitting units mounted on said first and second surfaces wherein said first heat-dissipating holes are angularly spaced apart from each other, wherein said first heat-dissipating holes are angularly spaced apart from each other, wherein some of said light emitting units are angularly spaced apart from each other, are mounted on said first surface of said base plate, and are respectively spaced apart from said first heat-dissipating holes, and wherein the remainder of said light emitting units are angularly spaced apart from each other, are mounted on said second surface of said base plate, and are respectively spaced apart from said first heat-dissipating holes.

2. The lamp assembly as claimed in claim 1, wherein said second heat-dissipating holes surround said light emitting units.

3. The lamp assembly as claimed in claim 1, further comprising a driving unit mounted on said second surface of said base plate and connected electrically to said light emitting units for driving operation of said light emitting units.

4. A lamp device comprising:

a lamp seat;

said lamp assembly as claimed in claim 1; and a transparent lamp shade that is connected to said lamp seat, and that encloses said lamp assembly therein.

5. The lamp device as claimed in claim 4, wherein said second heat-dissipating holes surround said light emitting units.

6. The lamp device as claimed in claim 4, further comprising a driving unit mounted on said second surface of said base plate and connected electrically to said light emitting units for driving operation of said light emitting units.

7. The lamp device as claimed in claim 4, wherein said lamp shade includes:

an upper shade member; and a lower shade member that is connected to said lamp seat, that cooperates with said upper shade member to define an internal space therebetween, and that includes a mounting seat disposed in said internal space and mounted with said lamp assembly.

8. The lamp as claimed in claim 7, wherein said mounting seat of said lamp shade has:

a round wall having a top surface that supports said second surface of said base plate thereon; and a fastening wall having a surrounding portion that is connected to said top surface and that surrounds said base plate, and a lock portion that is connected to a top end of said surrounding portion, that extends inwardly, that abuts against said first surface of said base plate, and that has an inclined inner surrounding surface for facilitating mounting of said base plate.

9. A lamp assembly comprising:

a base plate that has a first surface and a second surface opposite to said first surface, and that is formed with a plurality of first heat-dissipating holes extending through said first and second surfaces, and a plurality of second heat-dissipating holes extending through said first and second surfaces and possessing a diameter smaller than that of said first heat-dissipating holes;

a plurality of light emitting units mounted on said first and second surfaces wherein said first heat-dissipating holes are angularly spaced apart from each other; and a driving unit mounted on said second surface of said base plate and connected electrically to said light emitting units for driving operation of said light emitting units.

* * * * *